US005468154A

United States Patent [19]

Yip et al.

[11] Patent Number: 5,468,154

[45] Date of Patent: Nov. 21, 1995

[54] MULTI-PIECE HOUSING CARD EDGE CONNECTOR WITH MOUNTING ARMS

[75] Inventors: Maxwell K. Yip, Trumbull; Nino R. Suffredini, Monroe; Ronald P. Sidor, Stratford, all of Conn.; Robert C. White, Cliffside Park, N.J.

[73] Assignee: Burndy Corporation, Norwalk, Conn.

[21] Appl. No.: 167,578

[22] Filed: Dec. 15, 1993

[51] Int. Cl.[6] ..... H01R 13/648

[52] U.S. Cl. ..... 439/79; 439/381

[58] Field of Search ..... 439/79–83, 567, 439/572, 329, 751, 325, 571, 867, 381

[56] References Cited

U.S. PATENT DOCUMENTS

| | | | |
|---|---|---|---|
| 2,946,033 | 7/1960 | Wirth, Jr. | 439/325 |
| 4,080,041 | 3/1978 | Hawkins, Jr. | 439/79 |
| 4,756,694 | 7/1988 | Billman et al. | 439/61 |
| 4,857,017 | 8/1989 | Erk | 439/79 |
| 4,934,961 | 6/1990 | Piorunneck et al. | 439/637 |
| 5,104,326 | 4/1992 | Smith et al. | 439/79 |
| 5,117,330 | 5/1992 | Miazga | 439/567 |
| 5,249,974 | 10/1993 | Wang | 439/79 |

OTHER PUBLICATIONS

"The Connector Selector", Master Catalog, Burndy Corporation, vol. 2, pp. 7–18;7–21, 1986.

*Primary Examiner*—Gary F. Paumen
*Assistant Examiner*—Hien D. Vu
*Attorney, Agent, or Firm*—Perman & Green

[57] ABSTRACT

An electrical connector is provided with a housing having a first member and a second member, electrical contacts, and retention members. The electrical contacts are fixedly connected to the first member and extend through the second member. The retention members fixedly connect the first and second housing members to each other and, include a mounting section for mounting the housing to a printed circuit board.

15 Claims, 2 Drawing Sheets

FIG. 3.
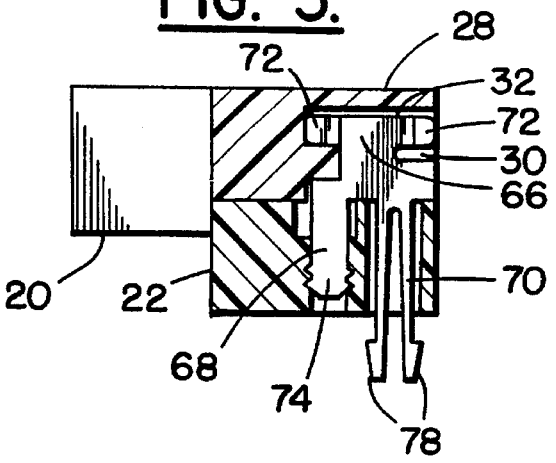
FIG. 4.
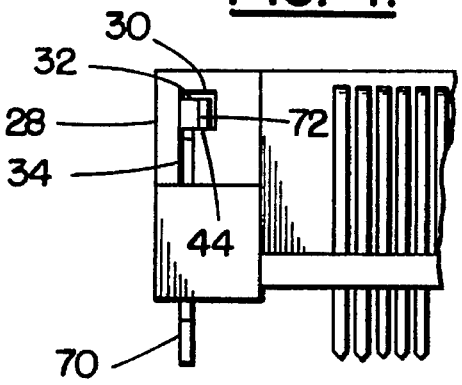
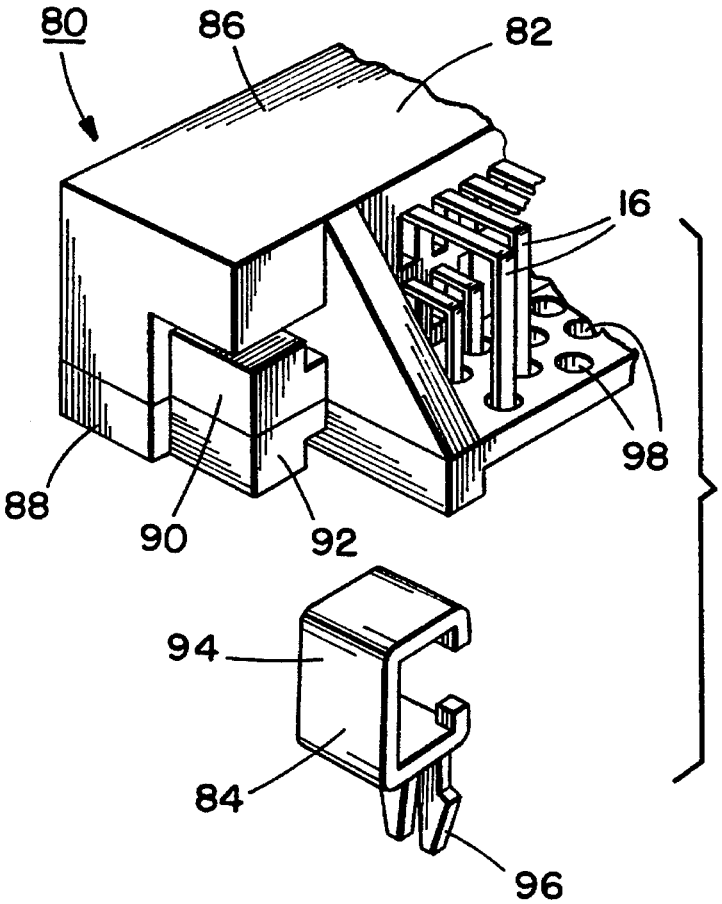
FIG. 5.

MULTI-PIECE HOUSING CARD EDGE CONNECTOR WITH MOUNTING ARMS

BACKGROUND OF THE INVENTION

1. Field of the Invention

The present invention relates to electrical connectors and, more particularly, to a retention member that connects housing members to each other and connects the housing to a printed circuit board.

2. Prior Art

U.S. Pat. No. 4,934,961 discloses a bi-level card edge connector. U.S. Pat. No. 4,756,694 discloses a card edge connector with angled solder tails. Burndy Corporation of Norwalk, Conn. manufactures and sells right angle card edge connectors having solder tails that are bent 90° after they exit the rear end of the housing of the connector.

SUMMARY OF THE INVENTION

In accordance with one embodiment of the present invention an electrical connector is provided comprising a housing, electrical contacts, and retention members. The housing has a first member and a second member. The electrical contacts are fixedly connected to the first member and extend through the second member. The retention members fixedly connect the first and second members to each other. Each retention member has a mounting section for mounting the housing to a printed circuit board.

In accordance with another embodiment of the present invention an electrical connector is provided comprising a housing, electrical contacts, and retention members. The housing has a first member and a second member. The electrical contacts are mounted to the housing. The retention members are connected to the housing. Each retention member has means for fixedly connecting the first and second members to each other and, means for fixedly connecting the housing to a printed circuit board.

In accordance with another embodiment of the present invention an electrical connector for electrically connecting a first printed circuit board to a second printed circuit board is provided comprising a first housing member, a second housing member, retention members, and electrical contacts. The first housing member has a card edge receiving area and first retention member receiving areas. The second housing member has second retention member receiving areas and contact passages. The retention members are located in the first and second retention member receiving areas and fixedly connect the first and second housing members to each other. The retention members have extended ends that extend past the second housing member for positioning in holes of the second printed circuit board. The electrical contacts are fixedly connected to the first housing member and extend through the second housing member. The electrical contacts have at least one turn that redirects the contacts about 90° between the first and second housing members.

BRIEF DESCRIPTION OF THE DRAWINGS

The foregoing aspects and other features of the invention are explained in the following description, taken in connection with the accompanying drawings, wherein:

FIG. 3 is a sectional view of the connector shown in FIG. 1 taken along line 3—3;

FIG. 4 is a partial rear elevational view of one end of the connector shown in FIG. 1; and FIG. 5 is a partial exploded perspective view of one end of an alternate embodiment of a connector.

DETAILED DESCRIPTION OF THE INVENTION

Figure 1:
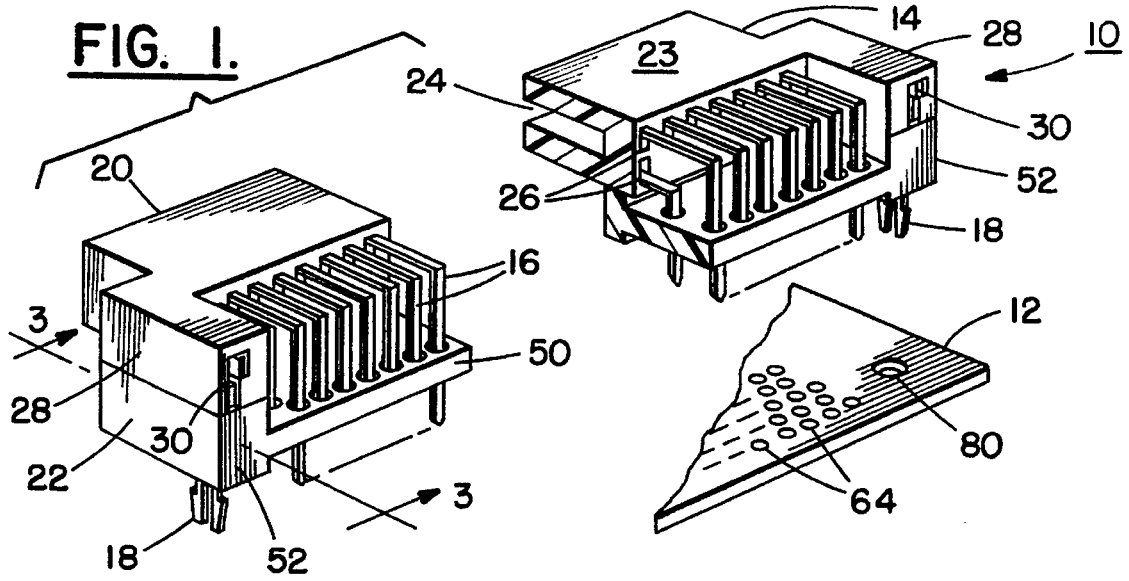
FIG. 1 is a perspective view of a card edge connector incorporating features of the present invention, with a cutaway section, for mounting to a printed circuit board.

Referring to FIG. 1, there is shown a perspective view of a card edge connector 10 for connecting a daughter printed circuit board (not shown) to a mother printed circuit board 12. Although the present invention will be described with reference to the embodiments shown in the drawings, it should be understood that features of the present invention can be embodied in many alternative forms of the embodiments. In addition, any suitable size, shape or type of elements or materials could be used.

Figure 2:
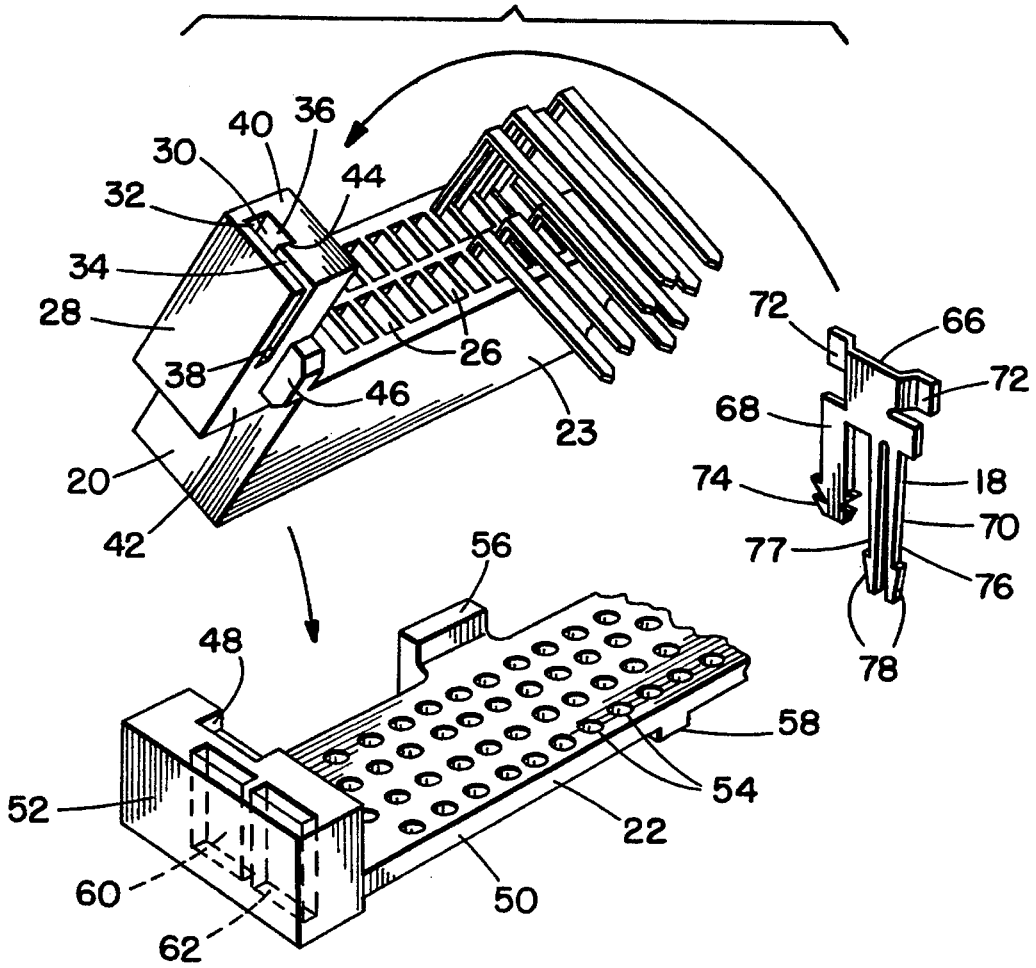
FIG. 2 is a partial exploded perspective view of one end of the connector shown in FIG. 1.

The connector 10 is shown in FIG. 1 with its center section cut away for illustration purposes only. The connector 10 generally comprises a housing 14, electrical contacts 16, and retention members 18. The housing 14 is comprised of two members 20, 22 that are made of a dielectric material, such as a molded polymer or plastic material. In alternate embodiments more than two members could be used to form the housing 14. Referring also to FIG. 2–4, the first member 20 generally comprises a center section 23 with a card edge receiving area or slot 24 and a plurality of contact receiving channels 26, and two end sections 28 on opposite ends of the center section 23. The channels 26 open into the card edge receiving slot 24. The end sections 28 have first retention member receiving areas 30. Each receiving area 30 has a slot shape with a large section 32, a small section 34, and apertures 36, 38 on two orthogonal sides 40, 42 into the slot shape. A ledge 44 is established at the bottom of the large section 32 adjacent the top of the small section 34. A protrusion 46 is provided at each end section 28 to be received in notches 48 in the second member 22. The protrusions 46 and notches 48 help in registration of the two members 20, 22 relative to each other.

The second member 22 generally comprises a center section 50 and two end sections 52. The center section 50 has a plurality of contact passages or holes 54 for portions of the contacts 16 to pass through, spacer standoffs 56, and standoffs 58. The center section 50 functions as a keeper to keep the contacts properly spaced for insertion into holes 64 in the mother board 12. The spacer standoffs 56 perform two functions. First, the spacer standoffs 56 contact the top surface of the mother board 12 to function as a standoff for the second member 22. Second, the spacer standoffs 56 contact the bottom of the first member 20 to help space the first member 20 from the mother board. The two end sections 52 each have a notch 48 and two passages 60, 62. The passages 60, 62 extend from a top surface of the end sections 52 to a bottom surface.

The contacts 16 are comprised of electrically conductive material. The contacts 16 are fixedly mounted to the first housing member 20 in the contact receiving channels 26. Spring contact portions of the contacts extend from the channels 26 into the card edge receiving area 24. In a preferred embodiment, the spring contact portions are arranged in an EISA connector format with a bi-level pattern in the area 24. The bi-level EISA connector format is generally described in U.S. Pat. No. 4,934,961, which is hereby incorporated by reference in its entirety. The rear ends of the contacts 16 are bent 90°. In the embodiment shown, the connector 10 is a parallel card edge connector; not a perpendicular card edge connector as described in U.S. Pat. No. 4,934,961. After their bends, the rear ends of the contacts 16 pass through the holes 54 in the second member 22. The rear ends of the contacts 16 extend past the bottom of the second member 22 for being located in contact holes 64 in the mother board 12.

The retention members 18 are preferably made of metal, such as sheet metal, that is cut and stamped into the shape shown. The retention members 18 each have a first section 66, a second section 68, and a third mounting section 70. The retention members serve two functions. First, the retention members 18 fixedly connect the two housing members 20, 22 to each other. Second, the retention members 18 fixedly attach the housing 14 to the mother printed circuit board 12. The first and second sections 66, 68 cooperate to fixedly connect the two housing members 20, 22 to each other. The first section 66 is inserted through the side aperture 36 into the receiving area 30 of the first member 20. The first section 66 has offset wings 72 that are received in the large area 32 and can contact the ledge 44. This prevents the retention member 18 from being pulled out of the receiving area 30 through the aperture 38. After the retention members 18 are located in the receiving areas 30, the two members 20, 22 are connected to each other with the second and third sections 68, 70 being positioned into the passages 60, 62, respectively, of the second member 22. The second section 68 has a barbed tip 74 that fixedly attaches the retention member 18 to the second member 22 in the passage 60. The third mounting section 70 passes through the passage 62 and extends past the bottom of the second member 22. The third mounting section 70 is generally comprised of two spring cantilever retention arms 76, 77 having enlarged heads 78 at the distal ends of the arms. The arms 76, 77 are adapted to deflect towards each other, when the connector 10 is mounted on the mother board 12, and then spring back towards their original shape. The heads 78 are positioned through the holes 80 (only one of which is shown) in the mother board 12. At the same time, the rear ends of the contacts 16 are located into the holes 64.

The two piece housing design is provided to make assembly of the connector 10 easier. The 90° bend of the rear ends of the contacts makes the use of a single piece housing impracticable. Therefore, because a multi-piece housing needs to be used, the present invention uses a single type of member to provide both the feature of mounting of the connector housing to the mother board and the feature of connecting the two housing members to each other. This reduces costs of manufacturing and makes the connector 10 simple in design and fabrication.

Referring now to FIG. 5, there is shown an alternate embodiment of the present invention. The connector 80 has a housing 82, contacts 16, and retention members 84 (only one of which is shown). The housing 82 has a first member 86 and a second member 88. Located at opposite ends of the two members 86, 88 are projections 90, 92. The retention members 84 have a c-shaped section 94 adapted to mount over the projections 90, 92 and a retention section 96 for mounting the connector 80 to a mother printed circuit board. In this embodiment, the contacts 16 are connected to the first housing member 86, the second housing member 88 is positioned against the first housing member 86 (with the contacts 16 passing through holes 98), and then the retention members 84 are fixedly connected to the projections 90, 92. Thus, I the retention members 84 provide both functions of fixedly connecting the two housing members 86, 88 to each other and, fixedly connecting the housing to the mother printed circuit board.

It should be understood that the foregoing description is only illustrative of the invention. Various alternatives and modifications can be devised by those skilled in the art without departing from the spirit of the invention. Accordingly, the present invention is intended to embrace all such alternatives, modifications are variances which fall within the scope of the appended claims.

What is claimed is:

1. An electrical connector comprising:

a housing having a first member and a second member;

electrical contacts fixedly connected to the first member and extending through the second member; and at least two spaced retention members, each retention member individually and independently fixedly connecting the first and second members to each other and having a mounting section for mounting the housing to a printed circuit board, wherein the retention members each include a first section interlockingly positioned in a first retention member receiving area in the first member and each first retention member receiving area has a slot shape with a large section, a small section, and apertures on two orthogonal sides of the first member into the slot shape.

2. A connector as in claim 1 wherein the first and second members are comprised of molder polymer material and the retention members are comprised of metal.

3. A connector as in claim 1 wherein the first member includes a card edge receiving area.

4. A connector as in claim 3 wherein the second member includes a keeper section substantially parallel to the card edge receiving area.

5. A connector as in claim 1 wherein the retention members each include a second section fixedly connected to the second member.

6. A connector as in claim 1 wherein the mounting section includes two spring cantilever retention arms having enlarged heads at distal ends of the arms for snapping into a hole in the printed circuit board.

7. A connector as in claim 1 wherein the retention members are formed from a flat sheet of metal that is cut and formed such that the retention members are substantially flat except for their first sections which have a flat offset shape.

8. An electrical connector comprising:

a housing having a first member and a second member;

electrical contacts mounted to the housing; and retention members connected to the housing, each retention member having means which fixedly connects the first and second members to each other including at least some of the retention members each having a first section interlockingly located in a slot of the first member, and means for fixedly connecting the housing to a printed circuit board, wherein the retention members are flat metal members having their first sections deformingly offset from a plane of the rest of the flat metal member.

9. A connector as in claim 8 wherein the means for fixedly connecting the first and second members to each other includes at least some of the retention members each having a second section fixedly connected to the second member.

10. A connector as in claim 9 wherein the means for fixedly connecting the housing to a printed circuit board includes two cantilever spring retention arms having enlarged heads at distal ends of the arms for snapping into a hole in the printed circuit board.

11. A connector as in claim 8 wherein first member includes a card edge receiving slot and the second member includes a keeper section parallel to and offset from the card edge receiving slot.

12. An electrical connector comprising:

a housing having a first member and a discrete second member;

electrical contacts mounted to the housing; and two retention members connecting the first and second members to each other, each retention member having a first section stationarily located in a receiving area of the first member, a second section directly fixedly attached to the second member, and a third section passing through and extending from the second member for mounting the housing to a printed circuit board.

13. A connector as in claim 12 wherein the first member receiving area for each retention member has a slot shape with an aperture extending along two orthogonal sides of the first member in a continuous fashion.

14. A connector as in claim 12 wherein the retention members are flat metal members each having a portion of their first sections deformingly offset from a plane of the rest of the flat metal member.

15. A connector as in claim 12 wherein the second member has two separate passages for each retention member, a first one of the passages having the second section connected therein and a second one of the passages having the third section passing therethrough.

* * * * *